United States Patent [19]

Luchi

[11] 4,146,062

[45] Mar. 27, 1979

[54] SELECTION SYSTEM FOR CONTROLLING THE HEALD LOOPS OF A WEAVING MACHINE OF THE NON-RECIPROCATING CONTINUOUS TYPE

[76] Inventor: Vinicio Luchi, Via Firenze 40H, Prato, Firenze, Italy

[21] Appl. No.: 794,231

[22] Filed: May 5, 1977

[30] Foreign Application Priority Data

May 13, 1976 [IT] Italy ..... 9449 A/76

[51] Int. Cl.[2] ..... D03D 47/26

[52] U.S. Cl. ..... 139/436

[58] Field of Search ..... 139/436, 13 R, 16

[56] References Cited

U.S. PATENT DOCUMENTS 446,085 2/1891 Stowe ..... 139/13 R 889,971 6/1908 Salisbury ..... 139/436

FOREIGN PATENT DOCUMENTS 2120583 4/1971 Fed. Rep. of Germany ..... 139/436

2202470 7/1973 Fed. Rep. of Germany ..... 139/436

1237034 7/1960 France ..... 139/436

*Primary Examiner*—Henry Jaudon

*Attorney, Agent, or Firm*—Haseltine, Lake & Waters

[57] ABSTRACT

A weaving machine of the non-reciprocating continuous type comprises a selection control system for the heald loops. The control system has sliding selectors which are linked to the loops and which are operated by selector controls mounted on carriages. The carriages are driven in synchronism with the operation of the weft carriers of the machine.

3 Claims, 19 Drawing Figures

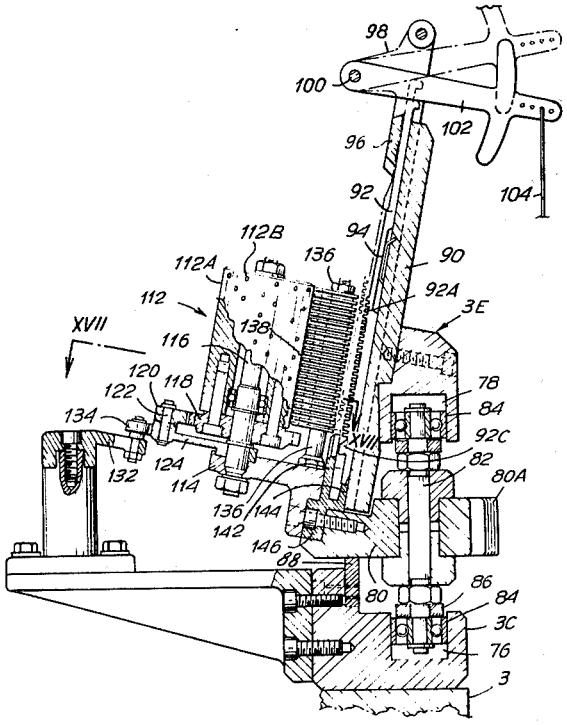

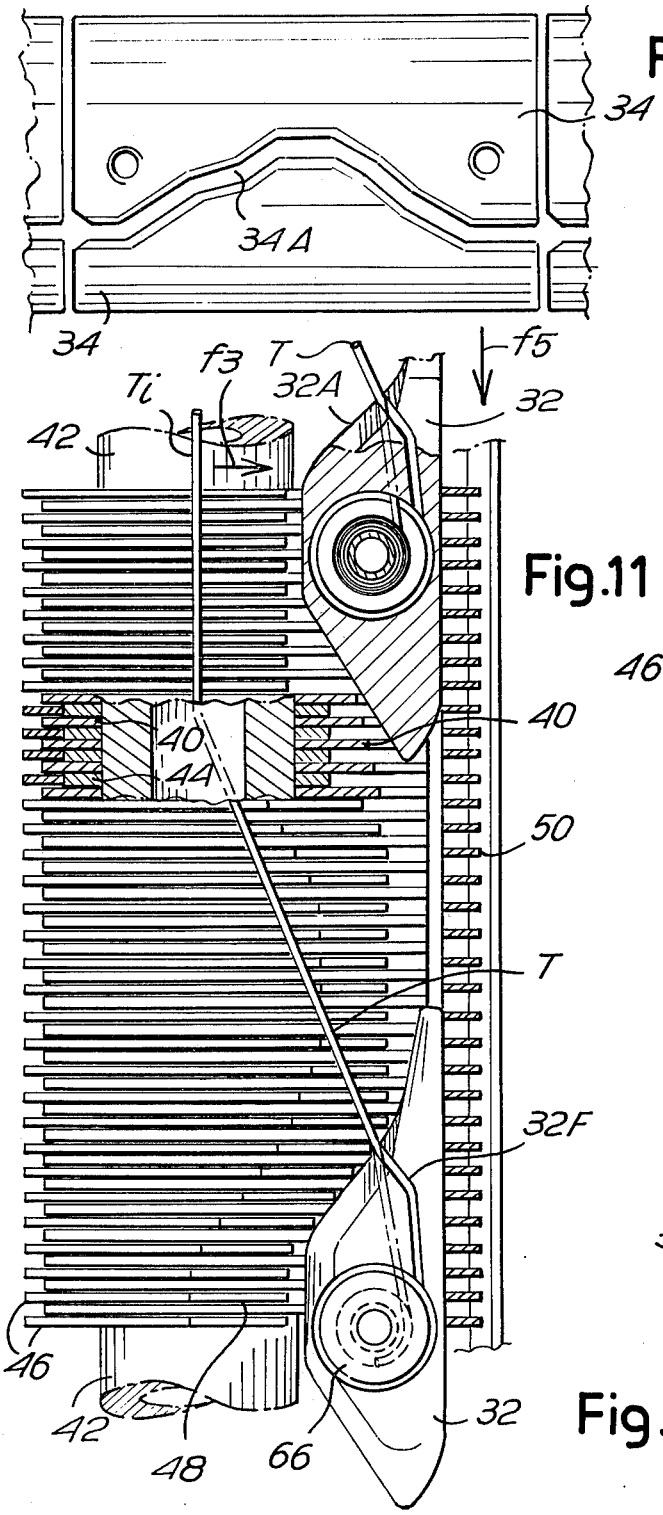
Fig.13
Fig.11
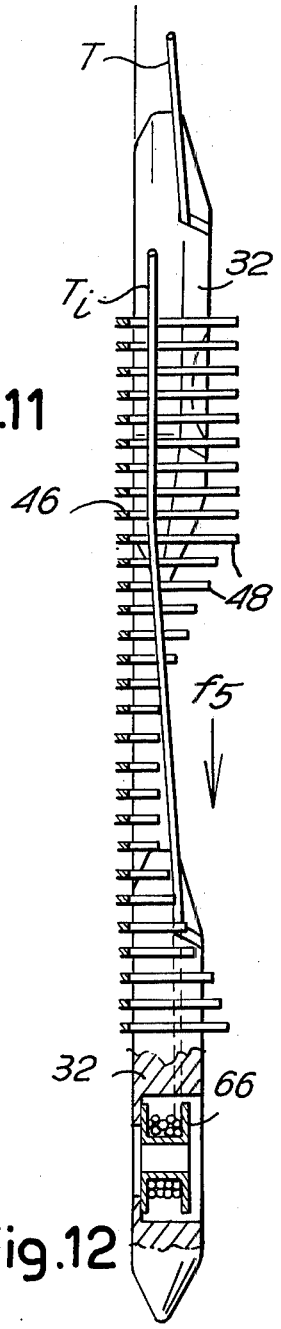
Fig.12

SELECTION SYSTEM FOR CONTROLLING THE HEALD LOOPS OF A WEAVING MACHINE OF THE NON-RECIPROCATING CONTINUOUS TYPE

FIELD OF THE INVENTION

The present invention relates to weaving machines and more particularly to a selection system for controlling the heald loops of a weaving machine of the non-reciprocating continuous type.

SUMMARY OF THE INVENTION

According to the present invention, there is provided in a weaving machine, heald loops, weft carriers, and a selection control system for the heald loops, said control system comprising a bed having grooves, a plurality of selectors slidable in the grooves of the bed, each selector being associated with at least one heald loop to move the loop against an opposing force, at least some of said selectors having butts, carriage means, means for advancing the carriage means in dependence on the operation of the weft carriers, and control means carried by the carriage means for actuating selected ones of the selectors, the selection being dependent on the presence of the butts.

Further according to the present invention, there is provided in a weaving machine of the non-reciprocating continuous type, weft carriers, means for advancing the weft carriers, heald loops for controlling the warps, and selection control means for the head loops, said selection control means comprising a stationary bed, an array of sliding selectors mounted in the bed and each associated with at least one heald loop to move the loop, means for actuating selected ones of the selectors, carriage means movable relative to the bed and carrying said actuating means, and drive means for advancing said carriage means in synchronism with the means for advancing the weft carriers.

In one preferred embodiment, which is particularly suitable for relatively small and uniform patterns, each carriage carries fixed or removable profiles acting on selector butts to provide the selection.

In another preferred embodiment, which is suitable for more sophisticated patterns, each carriage carries a selector program assembly which can be advanced stepwise by the action of fixed control stops arranged in accordance with the desired selection. The program assembly acts directly or indirectly on the selectors. In a especially preferred form of this embodiment, the carriages can be formed into a continuous chain and each carries a program drum in the form of a pin drum, the axis of which is parallel to the grooves in the bed. The selectors are rocking selectors and each drum is advanced by a ratchet gear operated by fixed stops and acts on levers or the like which, in turn, act on the selector butts.

Preferably, each selector is connected to a corresponding lever pivotally mounted on the bed, each lever being connected to a single heald loop or to a plurality of heald loops. Each lever also serves to amplify the effective selector stroke as applied to the associated heald loop or loops.

BRIEF DESCRIPTION OF THE DRAWINGS

An embodiment of the invention will now be described, by way of example only, with reference to the accompanying diagrammatic drawings, in which:

FIG. 11 is a view similar to that of FIG. 9, but partially in section;

FIG. 12 is a view similar to FIG. 10, but partially in section;

FIG. 13 is a fragmentary elevation of cam profiles for operating the weft-carriers or shuttles;

DESCRIPTION OF THE PREFERRED EMBODIMENT

Figure 1:
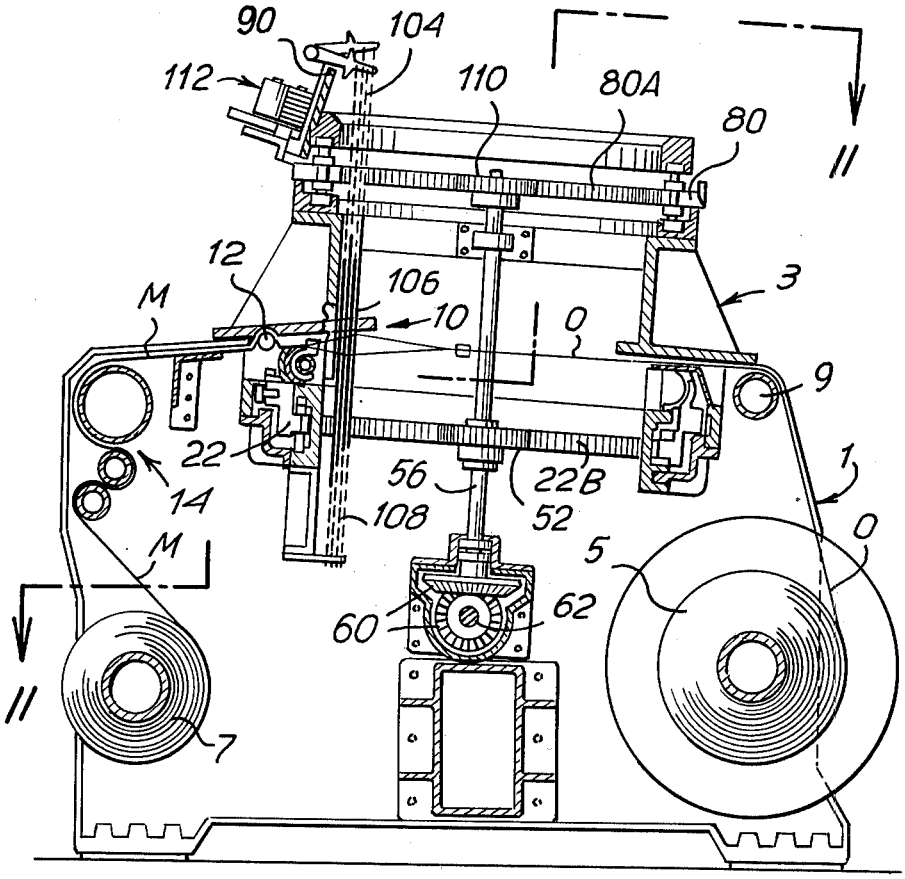
FIG. 1 is a cross-section of a weaving machine in accordance with the present invention.

The weaving machine shown in the accompanying drawings comprises a frame 1 with an overlying structure 3 for controlling weaving. This structure 3 is formed (see in particular FIG. 2) with two continuous annular tracks each including two parallel rectilinear portions, and arcuate connecting portions substantially of semi-circular form; the tracks are intended to guide chains to be described hereinafter. The numeral 5 denotes a warp beam, while 7 indicates a winding beam for the woven fabric. From the warp beam 5, the warps 0 are deflected over a bar 9, and reach a selection zone 10 in which the warps 0 are operated by means of heald loops or healds to then reach the weaving zone. The woven fabric M is engaged by a feed roller 12 and advanced to the beam 7, via a guide and braking unit 14 of a known type.

Figure 8:
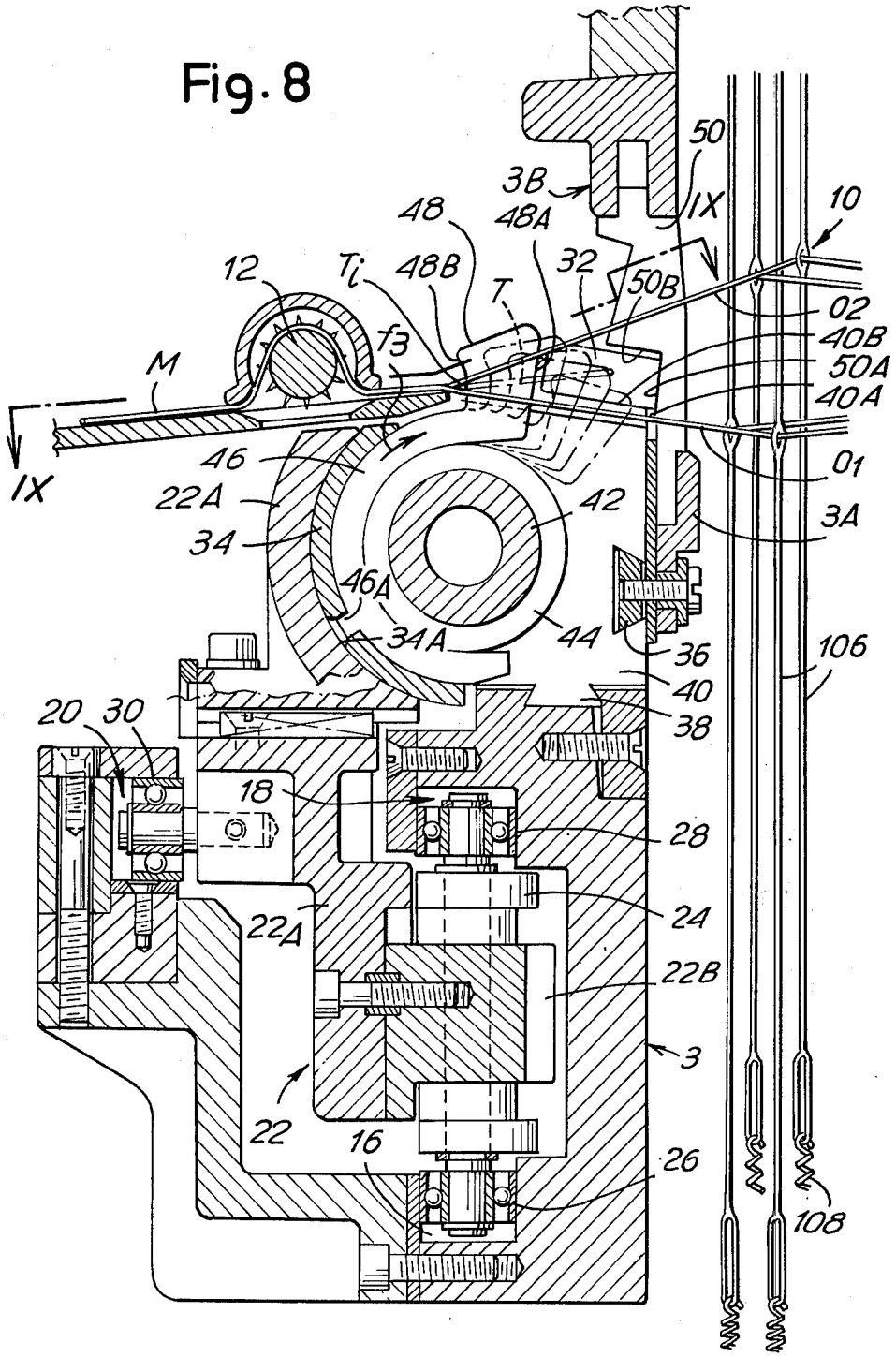
FIG. 8 is an enlarged detail of the portion indicated by arrow VIII of FIG. 3.

The first annular track is formed by channels or tracks 16, 18 and 20 (see FIGS. 2, 3 and 8) having rectilinear portions parallel to the beams 5 and 7 and to the array of heald loops, as well as semi-circular connecting portions. In the tracks 16, 18 and 20, carriage members 22 of a first chain are guided. The chain comprises, in addition to the members 22, pairs of chain links 24 connecting the carriage members 22 to each other. The carriage members 22 each comprise a pair of lower rollers 26 engaged in the track 16, a pair of upper rollers 28 engaged in the track 18, and a pair of lateral rollers 30 engaged in the track 20, the rollers 26 and 28 being coaxial and having a vertical axis and the rollers 30 having a horizontal axis and resting on the lower side of the track 20. Consequently, the carriage members 22 of the chain are firmly guided along the tracks formed therefor in the structure 3.

The chain is arranged to operate, with a non-reciprocating continuous motion, the feed of weft-carriers or shuttles generally denoted by 32. Each of the carriage members 22 has an arcuate body portion 22A (see FIGS. 3 and 8) which is provided with cam portions 34 of substantially semi-cylindrical form, the cam portions having control tracks or channels indicated by 34A (see FIGS. 8 and 13).

Blades 40 are assembled on the structure 3, using dove-tail means 36 and 38, the blades 40 each being shaped for dove-tailed engagement with the means 36 and 38 and each having an opening which receives a cylindrical bar 42 extending parallel to the weaving front and thus parallel to, and above, the tracks 16, 18. The blades 40 further have two upper profiles 40A and 40B which are shaped to allow the former a space sufficient to present the warps $0_1$ instantaneously in the lower position, while the latter serve to define a discontinuous supporting and sliding surface for the shuttles 32.

The cylindrical bar 42 is coaxial with the substantially semi-cylindrical cam portions 34 and on the bar 42 are mounted rings 44 defining the bottom of annular channels, the sides of which are defined by the blades 40; these annular channels serve as sliding seats for arcuate rocking sinkers 46 which are provided with a butt 46A engaged in the channels 34A of the cam portions 34. Further, each of the sinkers 46 has an extension 48 which projects through the warp shed between the adjacent warps to beat-up the just-inserted wefts, such as indicated by Ti in FIG. 8 adjacent the roller 12. The sinkers 46, are designed to rock in the annular channels about the axis of the bar 42, in such a manner as to be moved successively into a plurality of positions such as those indicated in broken lines in FIG. 8, for the hereinafter indicated purposes.

Figure 9:
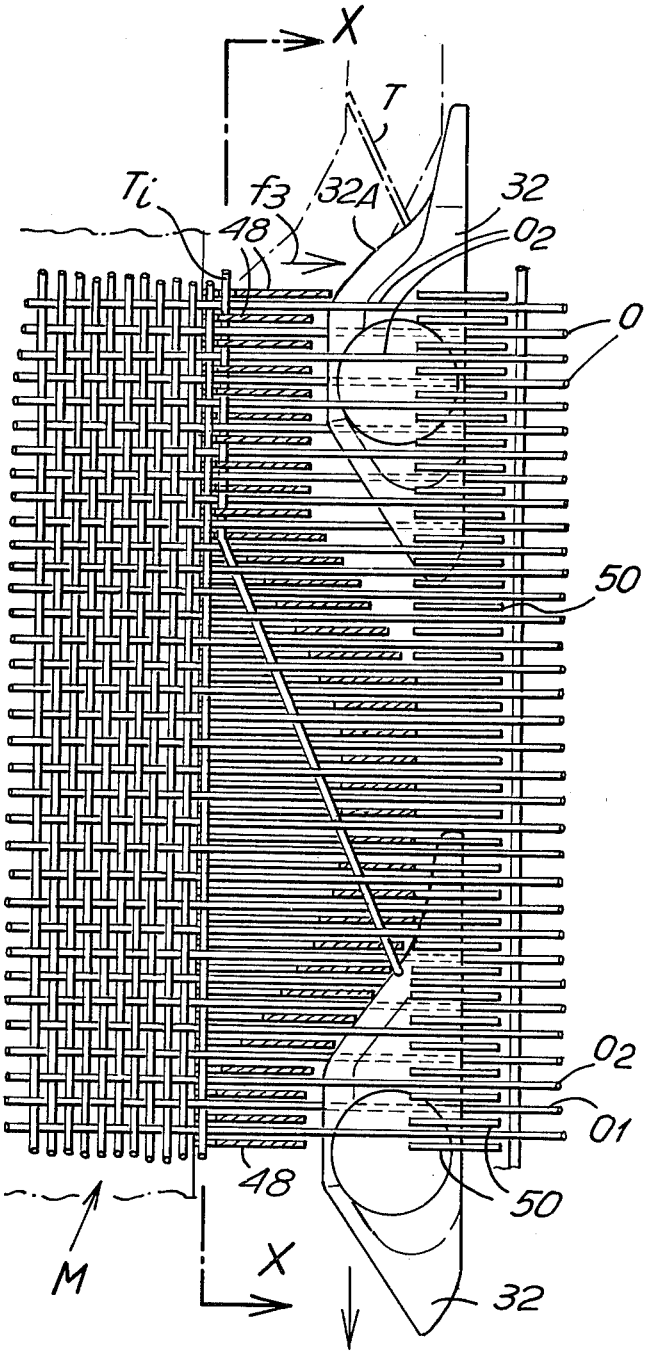
FIG. 9 is a view along line IX—IX of FIG. 8.
Figure 10:
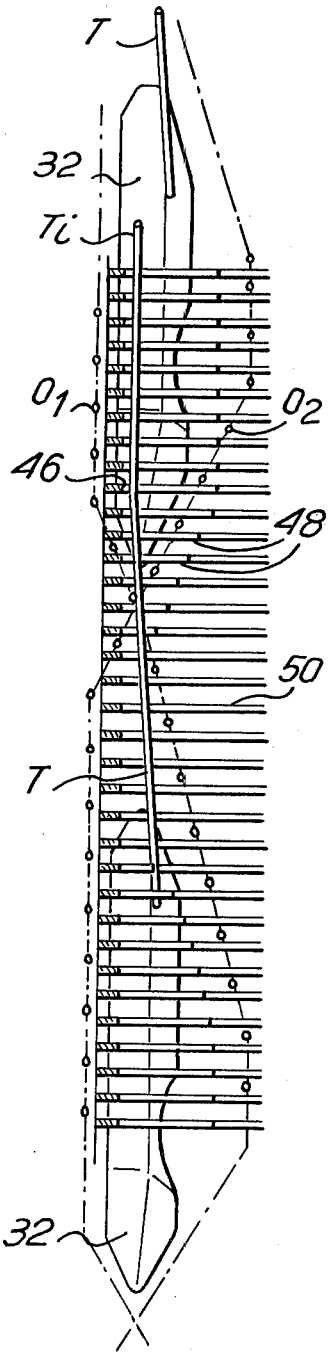
FIG. 10 is a view along line X—X of FIG. 9.

The structure 3 has lower and upper bar-like portions 3A and 3B (see FIG. 8) between which are mounted comb blades 50 which extend through the warp shed. The warps 0 pass between the comb blades 50 as is shown in FIG. 9 and the comb blades 50 are substantially coplanar with the extensions 48 of the sinkers 46. The comb blades 50 have a stepped profile 50A, 50B, the portions 50A of which form, with the profiles 40A, a lateral support for the shuttles 32 transversely to the sliding surface defined by the profiles 40B. The portions 50B of the stepped profile of the comb blades 50 form a guide for restraining, from above, the shuttles 32 against an accidental upwards movement out of the warp shed, in co-operation with the warps $O_2$ which are instantaneously located in the upper position in defining the warp shed.

Figure 2:
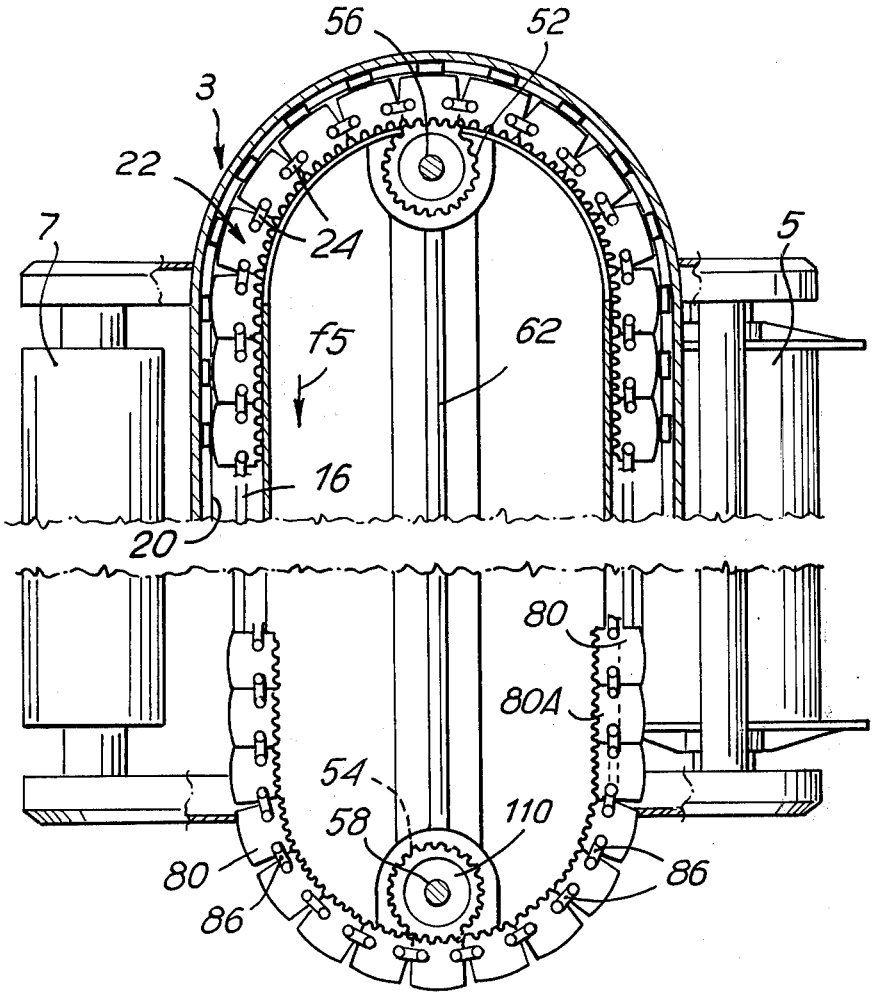
FIG. 2 is a horizontal section taken on line II—II of FIG. 1.
Figure 3:
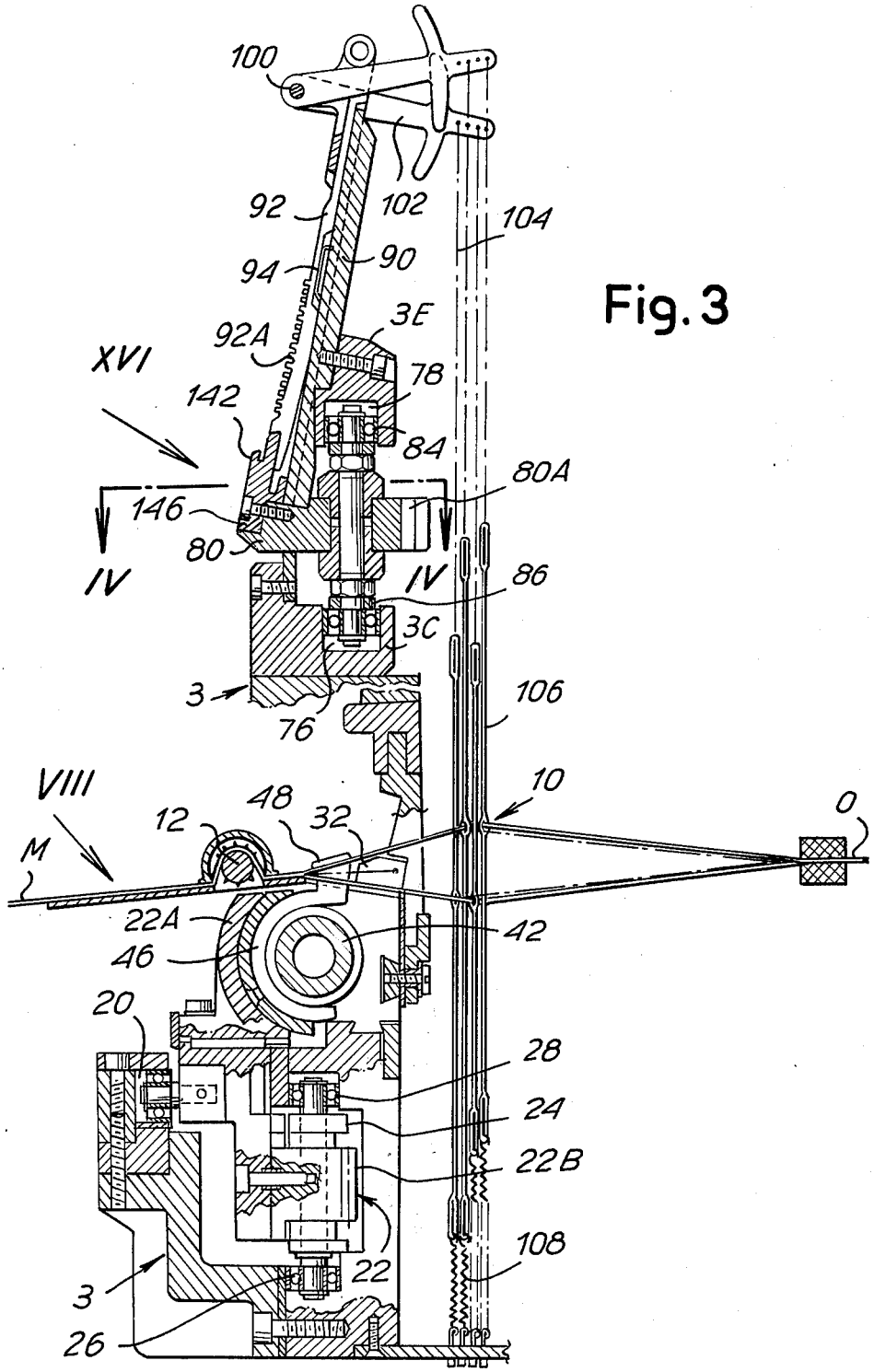
FIG. 3 is an enlargd detail of FIG. 1.

The carriage members 22 each have a toothed profile 22B on the surface thereof which forms the internal surface of the chain 22. As shown in FIG. 2, along the semi-circular connecting portions of guide tracks of the chain, the toothed profiles 22B of adjacent carriage members 22 are contiguous and are concentric with the connecting portions of the track to define an arcuate rack which meshes with gears 52, 54 effective to drive continuously the chain. The two gears 52, 54 are mounted on respective shafts 56, 58 and are driven, via mating bevel gears 60, by a drive shaft 62.

The shape of each of the shuttles 32 is clearly shown in FIGS. 9 and 11. In particular, each has an inclined rear profile 32A, on which forward profiles 48A of the sinker extensions 48 act when the latter are moved according to the arrows $f_3$, in a direction which is effective to advance the shuttles 32 according to the arrows $f_5$, this direction being the feed direction of the chain along the active portion for the formation of the fabric, the active portion being the left-hand portion in FIG. 2. The movement of the shuttles 32 is a continuous movement and occurs by advancing successive sinkers 46 so that the sinkers 46, by means of their profiles 48A, apply to each shuttle 32 a series of impulses which cause the shuttle to move through the warp shed in the direction of the arrow $f_3$, although the shuttle is separate from any other member and is guided along the profiles 40B, 40A, 50B and the upper warps $0_2$. The sinkers 46 are then successively retracted in the reverse direction to that of the arrow $f_3$ in preparation for the subsequent shuttle. In effect the advance and retraction of the successive sinkers 46 occurs with a wave-like motion (as may be seen in FIG. 9) and each shuttle 32 is advanced by the advancing wave. During its advance each shuttle 32 deposits a respective weft T, which is retained at the beginning of the active stroke of the shuttle outside of the fabric; the weft T is deposited in the warp shed and beating-up of the deposited weft is progressively effected by rear profiles 48B of the sinker extensions 48 when the sinkers 46 are retracted in the opposite direction to the arrow $f_3$. The interlacing action effected by the heald loops after the passage of each shuttle 32 determines the fabric structure.

The shuttles 32 are loaded with lengths of weft T in any suitable manner along the inactive part of the shuttle path.

Figure 14:
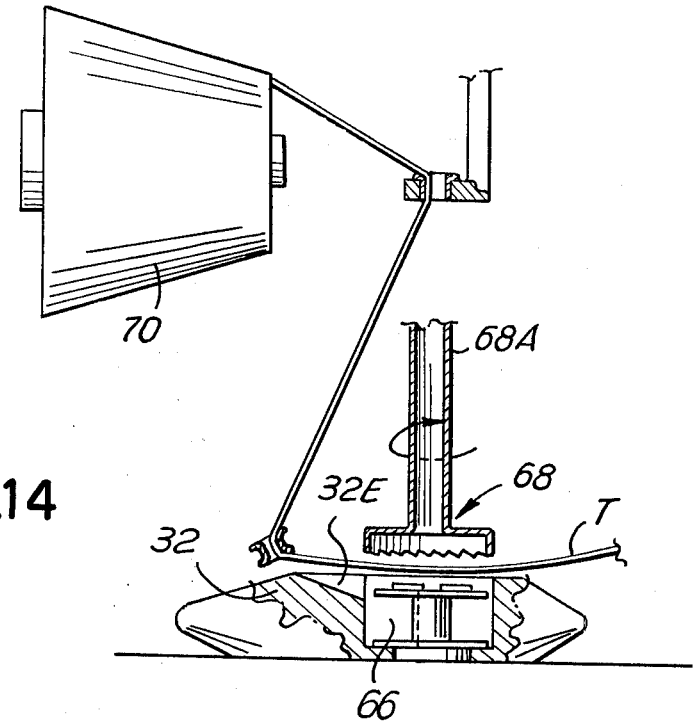
FIGS. 14 and 15 show schematically a system for charging a weft-carrier or shuttle with lengths of weft yarn during two stages of this operation.
Figure 15:
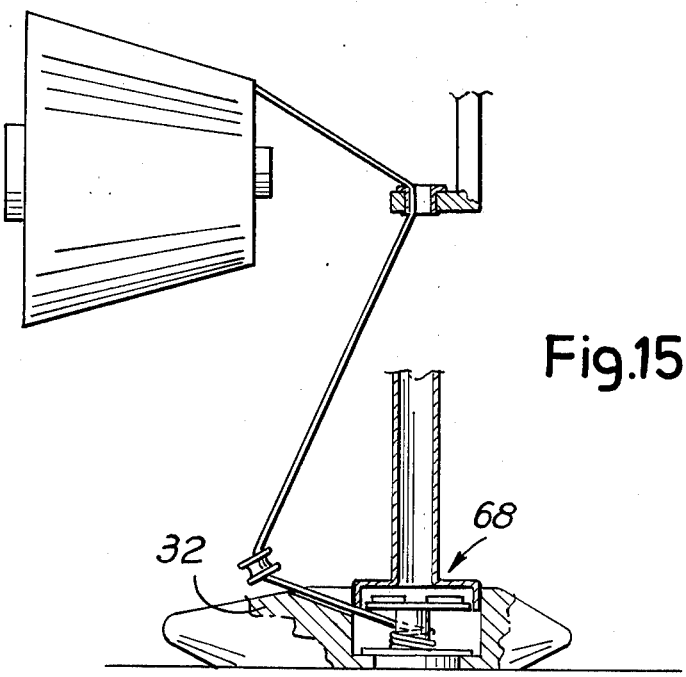

FIGS. 14 and 15 show one possible manner of loading the shuttles 32 with the lengths of weft to be distributed during each cycle along the annular path provided for the shuttles. Each shuttle has a seat 32E for a bobbin 66 which is rotated to wind and unwind the weft. At a position outside of the active portion of its path, the shuttle moves into a position in which its bobbin 66 is coupled to a rotary drive member 68 which, upon being inserted into the seat 32E, engages the bobbin 66 and causes it to rotate, and also hooks the weft T for winding the weft which is fed from a bobbin 70. The bobbin can have a toothed front edge to entrain the end of the weft during the initial winding of the yarn around the bobbin 66. The bobbin 66, which is braked by friction, can be rotated to permit the weft wound thereon, to unwind when the shuttle 32 is advanced along the active portion of its path to deposit the weft in the warp shed. The end of the weft is retained in a manner known per se by a clamp or by a suction device at the beginning of the active portion of the shuttle path, and the weft unwound from the bobbin 66 passes from the shuttle via a channel 32F in the body of the shuttle 32. The weft comes out above the extension 48 towards the end of the stroke of the sinker 46 in the direction of the arrow $f_3$, and the weft is taken by the rear profile 48B during the stroke of the sinker 46 in the opposite direction to that of the arrow $f_3$ to beat-up the weft.

The machine shown incorporates a selection system for the warp for forming Jacquard-type patterns. The selection system operates by selecting individual heald loops from the assembly thereof. The system will now be described in detail with particular reference to FIGS. 16 to 19.

Figure 4:
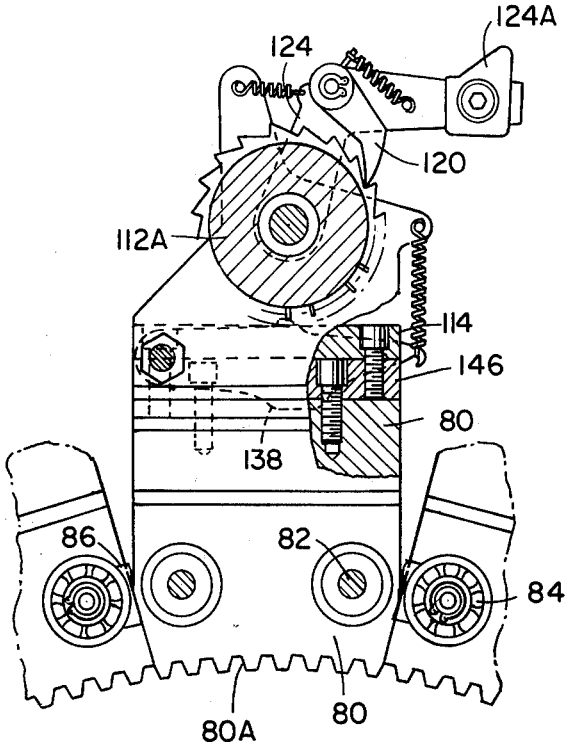
FIG. 4 is a section taken on line IV—IV of FIG. 3 showing part of a chain for operating warp pattern selectors.
Figure 17:
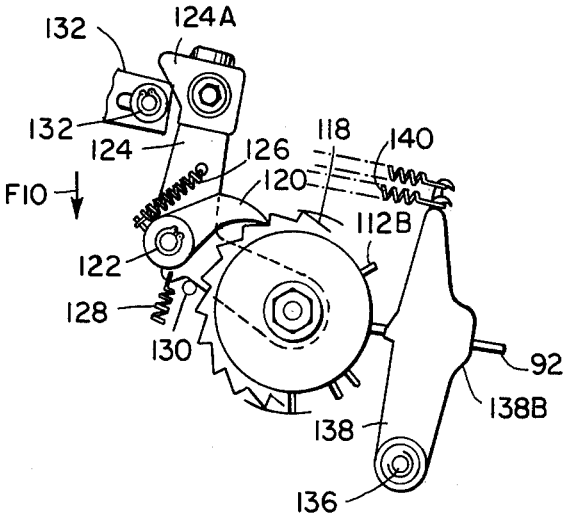
FIG. 17 is a section taken on line XVII—XVII of FIG. 16.
Figure 5:
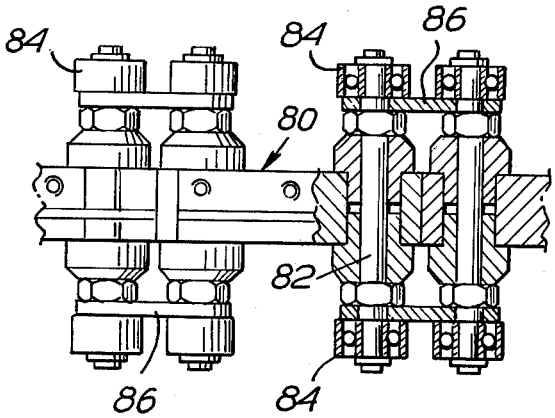
FIG. 5 is a fragmentary front elevation, partially in section, of the chain.
Figure 6:
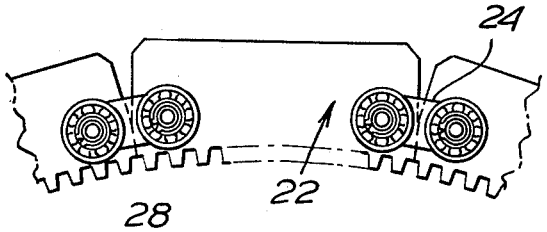
FIGS. 6 and 7 are views similar to FIGS. 4 and 5 of a chain for operating weft-carriers or shuttles.
Figure 7:
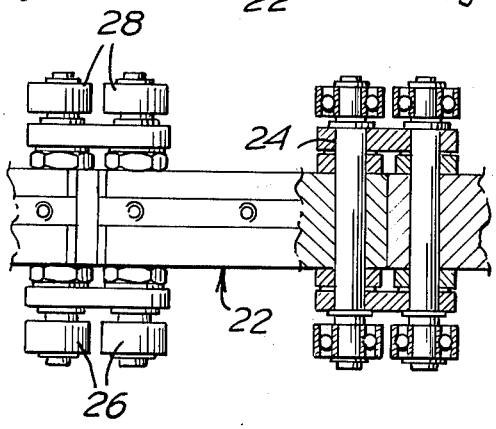

On the structure 3, with the aid of a structural element 3C and of supports, not shown, for an overlying element 3E, a second endless chain track is formed, the track being constituted by lower and upper channels 76, 78 formed in the respective elements 3C and 3E. A second chain is formed by blocks 80 (see also FIGS. 4 and 5), each having seats for two small shafts 82 carrying rollers 84 at each end, the shafts 82 being connected by chain links 86. The shafts 82 are vertically directed so that the rollers 84 are engaged in the channels 76, 78, and the weight of the chain assembly is supported on bearing means made of self-lubricating resin or the like.

Figure 16:
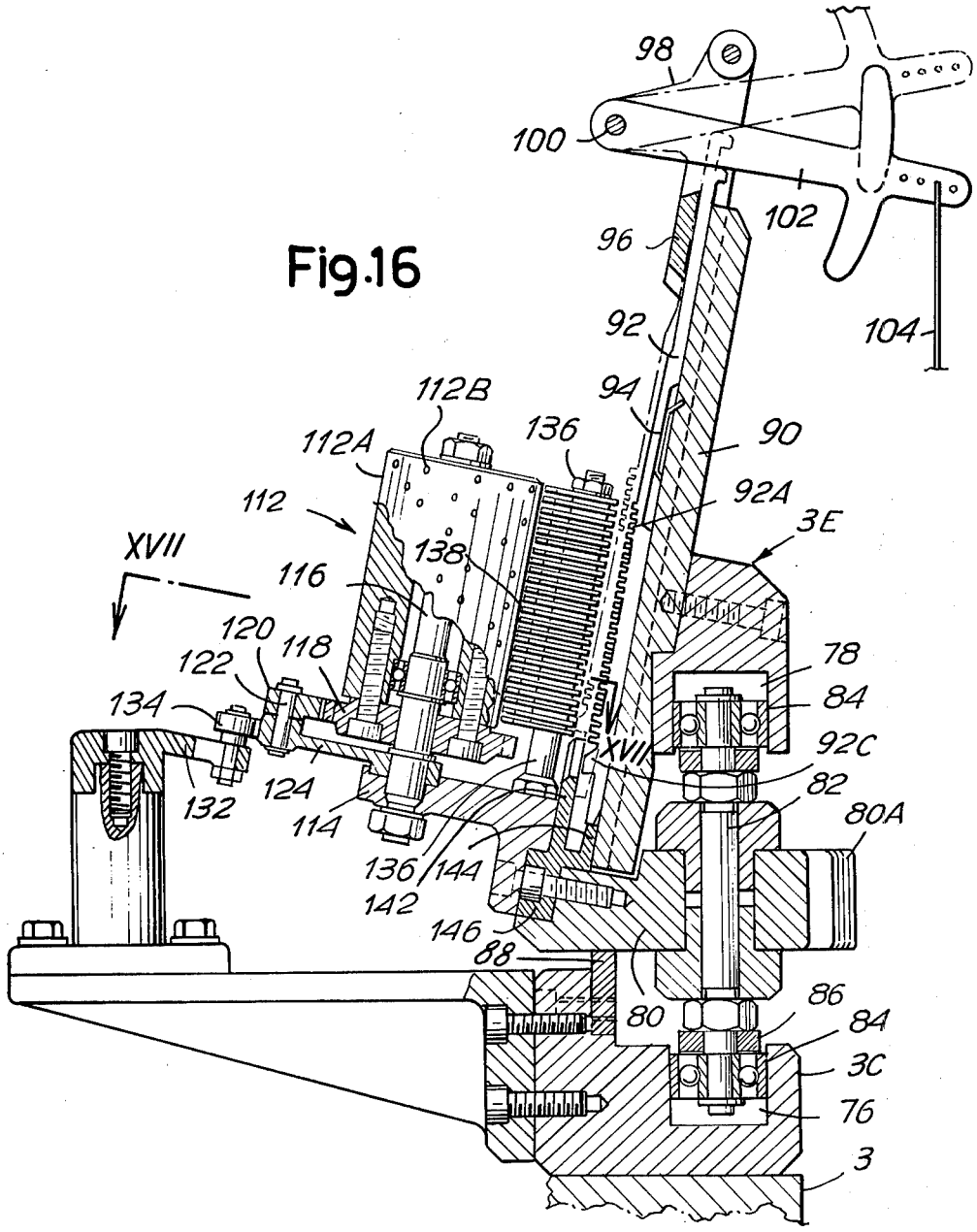
FIG. 16 shows an enlarged detail of the area indicated by arrow XVI of FIG. 3 with selector 92 in part, shown enlarged.
Figure 18:
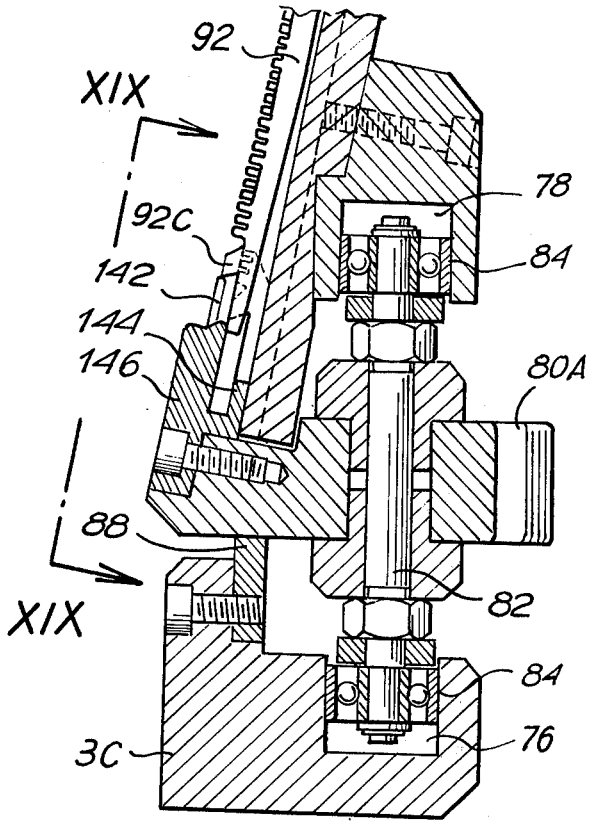
FIG. 18 shows a detail of FIG. 16 in a reversed view.
Figure 19:
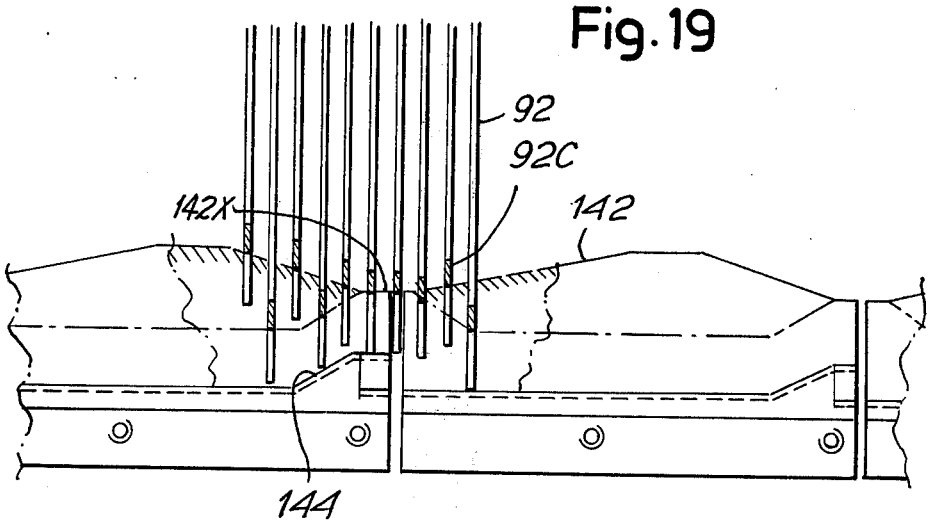
FIG. 19 is a view along line XIX—XIX of FIG. 18.

A bed 90 is mounted on the element 3E and extends along the or each rectilinear working section for the fabric. The bed 90 has vertical channels in which selector jacks 92 are slidable. The jacks, in the embodiment shown are of the press-selector type and rock in their own plane within the respective channels and are biased by respective springs 94 which act in a sense to urge the lower ends of the selectors 92 outwardly of the bed 90, the upper ends of the selectors being retained by the projection by means of a covering bar 96. Above the bed 90 supports 98 are provided to which are linked at 100, levers 102 which can pivot as shown in FIG. 16, from a lower position (shown in solid lines) to a raised position (shown in broken lines). Each lever 102 is associated with a different one of the selectors 92, and on each lever 102 there is hooked a tie-rod 104 for one or several heald loops 106, each having an eyelet through which a respective warp extends. Each heald loop 106 is urged downwardly by a tension spring 108, or by a weight, which imposes a downwards force both on the levers 102 and the selectors 92. The selectors 92 each have a row of removable butts 92A arranged to co-opeate with pattern drum members to be described. To summarize, for each warp there is provided a respective heald loop and each heald loop is associated with a lever 102 and a selector 92; the latter, when raised by the pattern drum members, in turn raises the lever 102 and thereby the associated heald loop (or loops) 106.

The chain formed by the elements 80, 82, 84, 86 is driven continuously by similar means to that provided for driving the first chain. In particular, each block 80 has, on its surface which lies inwardly of the chain path, teeth 80A, and the teeth of adjacent blocks 80 form an arcuate rack along semi-circular connecting portions of the chain track formed in the structure 3. On an extension of the shafts 56 above the gears 52 and 54 there are provided two gears 110, similar to the gears 52 and 54, for driving the second chain.

Each of the blocks 80 of the second chain corresponds to one of the carriage members 22 of the first chain and thus to means for causing a thrust wave for advancing a shuttle 32, and each block 80 carries a pattern drum unit, generally indicated by 112. More particularly, on each block 80 is mounted a bracket 114 carrying a shaft 116 on which is mounted a pattern drum 112A of the unit 112, the drum 112A being provided with pins 112B appropriately distributed to obtain a desired warp selection. A ratchet-toothed rim 118 is rigid with the drum 112A and on this rim there acts an oscillating pawl 120 provided with a reciprocating motion which is linked (see particularly FIG. 17) at 122 to a control lever 124. The lever 125 can rock around the base of the shaft 116 and is provided with a nose 124A at its end. Springs 126 and 128 respectively urge the pawl 120 in a clockwise direction with respect to the lever 124, and the lever 124 in a counterclockwise direction towards a stop 130. On the stationary stucture 3, a bracket portion 132 is mounted by means of supports (not shown) and which is provided with seats for locating stops 134, for instance, in the form of stationary rollers, which are intended to act on the noses 124A. Each time a nose 124A, after advance of the chain according to the arrow $f_{10}$ (see FIG. 17) meets a stop 134, the nose imposes a movement in a clockwise direction to the lever 124 and the latter advances the pawl 120 which, in turn, angularly displaces the drum 112A through one step. After passing the stop 134, the lever 124 is returned to rest against the stop 130 and the pawl 120 moves back on the toothed rim 118.

The bracket 114 also carries a second shaft 136 in a position between the bed 90 and the drum 112A. Levers 138 are pivoted on the shaft 126, the levers 138 being separate from one another and being urged by respective springs 140 in a direction towards the surface of the drum 112A. The levers 138 can be moved by the pins 112B in the opposite direction to the action of the springs 140, and are designed to act with a profile 138A on the butts present in the rows of butts 92A of the selectors. In this way, in the presence of a pin 12B and of a butt 92A, the lever 138 is capable of rocking the selector 92 into the interior of the channel in the bed 90 against the action of the spring 94. Thereby a selection is obtained by means of the single drums 112A which advance with the respective blocks 80 of the second chain. It is thus possible to obtain a selection of the heald loops in a similar manner to that provided by rocking selectors used in knitting machines. For this purpose, each selector 92 has, at its lower end, a butt 92C which is urged outwardly by the spring 94 into engagement with a cam profile 142 when the selector 92 is temporarily raised by a toothed profile 144, carried by, or formed by, a member 146 engaged between the block 80 and the bracket 114. Those selectors 92 having butts 92C which project from the bed 90 come into engagement with the cam profile 142 which raises these selectors against the action of the springs 108, with a consequent raising of the respective levers 102 and of the respective heald loops 106; those selectors which, on the contrary, are pressed into the interior of the respective grooves in the bed by the profiles 138A of the levers 138 (as a function of the pattern set by the drums 112A), after passing the toothed profile 144 do not engage the profile 142, and consequently are returned downwardly by the bias of the springs 108 or by the action of weights provided instead of the springs 108.

Thus a desired warp pattern is provided by a selection of the heald loops in synchronism with the advancement of the individual shuttles. As the control of the heald loops with this arrangement is combined with the means for advancing the shuttles one may also provide for the formation of a pattern in combination with particular weft yarns which are selectively loaded on the respective shuttles.

When the pattern allows it, it is also possible to act with stationary levers 138 instead of those selected with the pattern drums. In this case, the drums are inactive or can even be omitted.

Although the machine particularly described has only a single weaving front, the machine can be modified to have two weaving fronts and thus two selection systems for the heald loops 10, two systems for inserting the wefts, and two control units combined with two beds 90, the whole assembly being arranged on the two rectilinear parallel sections of the first and second chains. In this case, appropriate feed systems for the warps will be provided in the space between the two active lengths of the structure 3 and winding beams for the two fabrics simultaneously formed, while there will be provided means for feeding twice, the wefts from the individual shuttles during one cycle of each shuttle and of each of the chains; the shuttles and chains will be single to operate on both weaving fronts.

The machine particularly described is of relatively simple construction, and provides an efficient weft-carrier thrust, and is capable of beating-up the weft as soon as it is deposited.

The warp selection system particularly described has a performance comparable to that of a needle selection system of a knitting machine.

What is claimed is:

1. In a weaving machine, heald loops, weft carriers, and a selection control system for the heald loops, said control system comprising: a bed having grooves; a plurality of rocking selectors slidable in the grooves of the bed; a lever member with a plurality of hooking means associated with each selector for engaging at least one heald loop to move the loop against an opposing force, the number of selectors being a submultiple of the number of heald loops, said selectors having removable butts; defining a continuous chain carriage means; means for advancing the carriage means in dependence on the operation of the weft carriers, and control means carried by the carriage means for actuating designated selectors, the selection being dependent on the presence of the butts; said control means comprising means defining a butt control profile carried by each carriage means acting on the selector butts and a selector program assembly carried by said carriage means; each program assembly comprises a program drum and means mounting the drum for rotation about an axis parallel to the grooves; means for advancing the program assembly stepwise during advance of the carriage means, defined by a ratchet mechanism associated with each program drum and fixed stops for operating the ratchet mechanisms during advance of the carriage means, said program assembly being actionable on the selectors; and said control means further comprises movable intermediate members between the program drum and the selectors, the program drum acting on the selector butts via the intermediate members.

2. A weaving machine according to claim 1 wherein: said control lever member includes one end pivotably connected to fixed structure and cooperating in an intermediate position with a respective one of the selectors and with a plurality of hooking means for at least one of the heald loops whereby the heald loops are moved by the selectors via the corresponding levers, said levers acting to amplify the selector stroke as applied to the heald loops.

3. In a weaving machine, heald loops, weft carriers, and a selection control system for the heald loops, said control system comprising a bed having grooves, a plurality of rocking selectors slidable in the grooves of the bed, a control arm with a plurality of hooking means associated with each selector to engage at least one heald loop to move the loop against an opposing force, the number of selectors being a submultiple of the number of heald loops, said selectors having removable butts, carriage means defined by a continuous chain, means for advancing the carriage means in independence on the operation of the weft carriers, and control means carried by the carriage means for actuating selected ones of the selectors, the selection being dependent on the presence of the butts said control means comprising means defining a butt control profile carried by each carriage means and acting on the selector butts and a selector program assembly carried by said carriage means, each program assembly comprises a program drum and means mounting the drum for rotation about an axis parallel to the grooves; said machine further comprising means for advancing the program assemblies stepwise during the advance of the carriage means; said program assembly acting on the selectors; the means for advancing the program assemblies stepwise comprises a ratchet mechanism associated with each program drum and fixed stops for operating the ratchet mechanisms during advance of the carriage means, and each said control means further comprises movable intermediate members between the program drum and the selectors, the program drum acting on the selector butts via the intermediate members.

* * * * *